US006170383B1

(12) United States Patent
Mauritz

(10) Patent No.: US 6,170,383 B1
(45) Date of Patent: Jan. 9, 2001

(54) PISTON BYPASS VALVE

(75) Inventor: Forrest Mauritz, Monticello, IA (US)

(73) Assignee: Energy Manufacturing Co., Inc., Monticello, IA (US)

( * ) Notice: Under 35 U.S.C. 154(b), the term of this patent shall be extended for 0 days.

(21) Appl. No.: 09/232,308

(22) Filed: Jan. 15, 1999

(51) Int. Cl.[7] ..... F15B 15/22

(52) U.S. Cl. ..... 91/399; 91/422; 92/183

(58) Field of Search ..... 92/183; 91/422, 91/222, 399, 23, 401; 417/552

(56) References Cited

U.S. PATENT DOCUMENTS 239,494 * 3/1881 Haskin ..... 91/23
3,173,341 * 3/1965 Carpenter ..... 91/404
5,425,305 * 6/1995 Mauritz ..... 92/181 P

FOREIGN PATENT DOCUMENTS 58-5505 * 1/1983 (JP) .

* cited by examiner

*Primary Examiner*—Edward K. Look
*Assistant Examiner*—Thomas E. Lazo
(74) *Attorney, Agent, or Firm*—Allan L. Harms

(57) ABSTRACT

A bypass valve is disclosed which relieves pressure on the end cap and rod guide of a cylinder as the piston approaches them. The bypass valve has a cylindrical body with end caps on each end, the end caps serving as stop members. The bypass valve is provided with longitudinal grooves along the cylinder body, along which working fluid can pass through a bore in the piston in which the bypass valve is inserted. Inner smaller diameter counterbores and outer larger diameter counterbores are provided coaxially with the bore on the opposing faces of the piston. The end caps of the bypass valve are received in the counterbores when the piston is urged along the cylinder. When the piston approaches either the rod guide or the end cap, the bypass valve is urged away from its seated position when an end cap of the bypass valve touches the approached rod guide or end cap of the cylinder.

20 Claims, 7 Drawing Sheets

PISTON BYPASS VALVE

BACKGROUND OF THE INVENTION

This invention relates to relief valves for pistons which serve to position equipment or levers.

In many equipment structures, particularly compactors, hydraulic cylinders are used in high pressure bi-directional operation over thousands of cycles to extend and retract compaction members and to retain the members in position. When hydraulic fluid is pumped into the hydraulic cylinder and the piston has traveled fully to the end of the cylinder, the hydraulic pump supplying fluid to the cylinder continues to apply pressure to the fluid and must be stopped to avoid an over pressure condition which stresses and damages the cylinder end cap and rod guide. In some existing systems, timer mechanisms are operable with the hydraulic pump to shut the pump off after the estimated time it takes for the piston to travel to an end of the cylinder. At best, this only approximates efficient operation.

In other prior art devices, a transducer is provided on the hydraulic cylinder to sense when a predetermined pressure is attained in the fluid input line. The transducer either sends a signal to the pump control to stop pumping, or to a switch valve to bypass the input line so that over stress conditions do not occur. The use of a transducer system requires addition of control apparatus to the hydraulic system.

Another prior art means for avoiding an over stress condition in the cylinder is by means of a relief valve in the cylinder or in the input line. This apparatus causes high heat build up and stress on the hydraulic pump.

A relief valve for a hydraulic piston is used in equipment manufactured by the Marathon Equipment Co. for compaction equipment, wherein a bypass valve member is positioned within a bore through the hydraulic piston such that the valve is displaced when its leading end engages the rod guide of the cylinder. When the valve is displaced, a central reduced diameter portion of the valve spool comes into registry with a pair of axial passageways which communicate with the edge of the piston. In this design the hydraulic fluid is routed around the outside of the valve spool in a manner similar to typical manual control valves. The design requires special machining operations in the piston to provide fluid passageways. The machining required to create the passageways adds considerable expense to the fabrication of the piston. This previous design depends on extremely tight spool-to-bore clearance to minimize leakage in the closed position. The tight clearance makes the valve vulnerable to malfunction if there are machining inaccuracies in the piston or valve. Also the valve function becomes very sensitive to minute particles of contamination that could wedge between the spool and bore. As the outside diameter of the spool becomes worn, the hydraulic fluid leakage will increase, reducing the efficiency of the cylinder. Further, this prior art valve only works when the piston is advanced in one direction and it is found to tend toward premature exhaustion.

Another prior art device comprises a spring loaded relief valve positioned through the piston allowing a passageway for fluid to escape from the advancing side of the piston to the following side when the valve is urged against its spring loading by engagement of the leading end of the valve with the cylinder end wall. As with the Marathon Equipment Co. design valve, the bore through the piston requires complicated machining to provide valve seats and spring engaging shoulders. This valve structure causes heat build up, operates only in one direction of movement of the piston, and is subject to premature wear.

The center flow bypass valve of my U.S. Pat. No. 5,425,305 issued Jun. 20, 1995, illustrates a piston relief valve having a hollow tubular midsection with ends closed by caps which serve as stops. Ports are formed in the tubular sidewall adjacent the end caps. The valve opens as the piston approaches either the end cap of the cylinder or the rod guide of the cylinder.

SUMMARY OF THE INVENTION

The invention relates to a valve mounted in a hydraulic cylinder piston that allows hydraulic fluid flow through the piston at the end of either the extend or retract stroke. The valve is opened as it makes contact with either the end cap or rod guide inside the cylinder. The valve is closed by pressure when hydraulic fluid flow is reversed to the cylinder after reaching the end of the stroke. The purpose of the valve is to relieve pressure-induced loading on the end cap or rod guide of the cylinder and to minimize problems with metal fatigue. The hydraulic energy expended by the cylinder is utilized in moving a load and not wasted by dead-heading the pump at the end of stroke.

The valve is slidably mounted in a close-fitting bore running through the piston. The valve bore is offset from and parallel with the piston center line. The valve is free to slide back and forth within the bore.

The valve spool consists of a cylindrical mid-section with one or more longitudinal grooves along it. The midsection has an axial threaded rod passing through it and extending from each end of the mid-section. An end cap is threaded onto each threaded rod. Each end cap is provided with a hollow cylindrical cup into which an end of the cylindrical mid-section is received. The longitudinal grooves allow hydraulic oil to flow through the piston when the valve is in the open position.

The end caps on the valve serve three functions: first, the end caps limit the spool travel and prevent it from escaping from the bore. Second, the end caps function as poppet valves to cut off flow of hydraulic fluid when they contact the surface of the piston. Third, the end caps act as a spear-type cushion when they enter a small two-stage hydraulic dash pot machined in the piston at each end of the bore where the spool is mounted. The cushion diminishes the shock as the valve shifts, and improves the long-term reliability of the valve.

Specifically each end cap is provided with a hollow cylindrical cup, the sidewall of which extends a short way along the midsection of the spool midsection. Each face of the piston is provided with a two-stage counterbore axially aligned with the bore provided for the relief valve spool mid-section. The outer bore of each two-stage counterbore is sized to receive an end cap of the valve spool. An inner smaller diameter counterbore is machined in the piston face such that the sidewall of the cup on the end cap will fit in the inner counterbore when the valve is closed. A small clearance is provided between the periphery of the end cap and the outer counterbore and similarly a small clearance is provided between the sidewall of the cup and the inner counterbore. Chamfers are provided on the outer edges of the end caps and the cups allow trapped hydraulic fluid to center the spool in the bore.

This invention reduces the complexity of the valve and improves its performance. The new design does not require the drilling of hydraulic oil passageways within the piston. All flow is directed along the exterior of the valve spool. The elimination of the drilled fluid passageways provides a considerable cost savings.

In a compactor environment, the relief valve must withstand high velocity seating in both the extend and retract strokes and must be reliable for hundreds of thousands of cycles. The use of dashpots formed by the inner and outer counterbores enables the valve to withstand bi-directional operations without metal fatigue because the two-stage counterbore provides a cushioning action as the valve end caps move toward their respective seats. The cushioning action of the dashpots prevents damage to the valve body in repeated extend and retract operations.

In order to minimize the size and cost of the valve and to maximize flow performance, a small threaded rod through the center is used to hold the valve parts together. The valve is required to function reliably with that delicate part for hundreds of thousands of cycles in a compactor. When the cylinder control valve is activated to extend or retract the cylinder, the bypass valve shifts to the limit of its travel at very high velocity. If no cushion is used, as the valve seats, the shock loads induced in the threaded rod will cause the threaded rod to fail within a few thousand cycles. The cushion reduces the valve velocity so that the shock is minimized when the valve contacts its seat and virtually eliminates fatigue problems. The threaded rod experiences no load outside of the shock loads.

It is an object of the invention to provide a relief valve for a hydraulic piston used in a compactor which is simple and inexpensive to manufacture and assemble. It is also an object of the invention to provide a relief valve which is very compact and which can withstand hundreds of thousands of bi-direction cycles. It is also an object of the invention to provide a relief valve for a hydraulic piston which allows minimal leakage of working fluid when the valve is closed. It is a further object of the invention to provide a relief valve for a hydraulic piston which cushions itself when changing state. It is also an object of the invention to provide a hydraulic piston with a relief valve which operates to alleviate stress on the end cap and rod guide of the cylinder in which the piston is driven. It is a further object of the invention to provide a hydraulic cylinder and piston with a relief valve which is not susceptible to heat build up. Another object of the invention is to provide a relief valve, the stops of which wear together with their seating surfaces to create improved sealing as use continues. These and other objects will be apparent from examination of the detailed description which follows.

DESCRIPTION OF THE DRAWING FIGURES

DETAILED DESCRIPTION OF THE INVENTION

Figure 1:
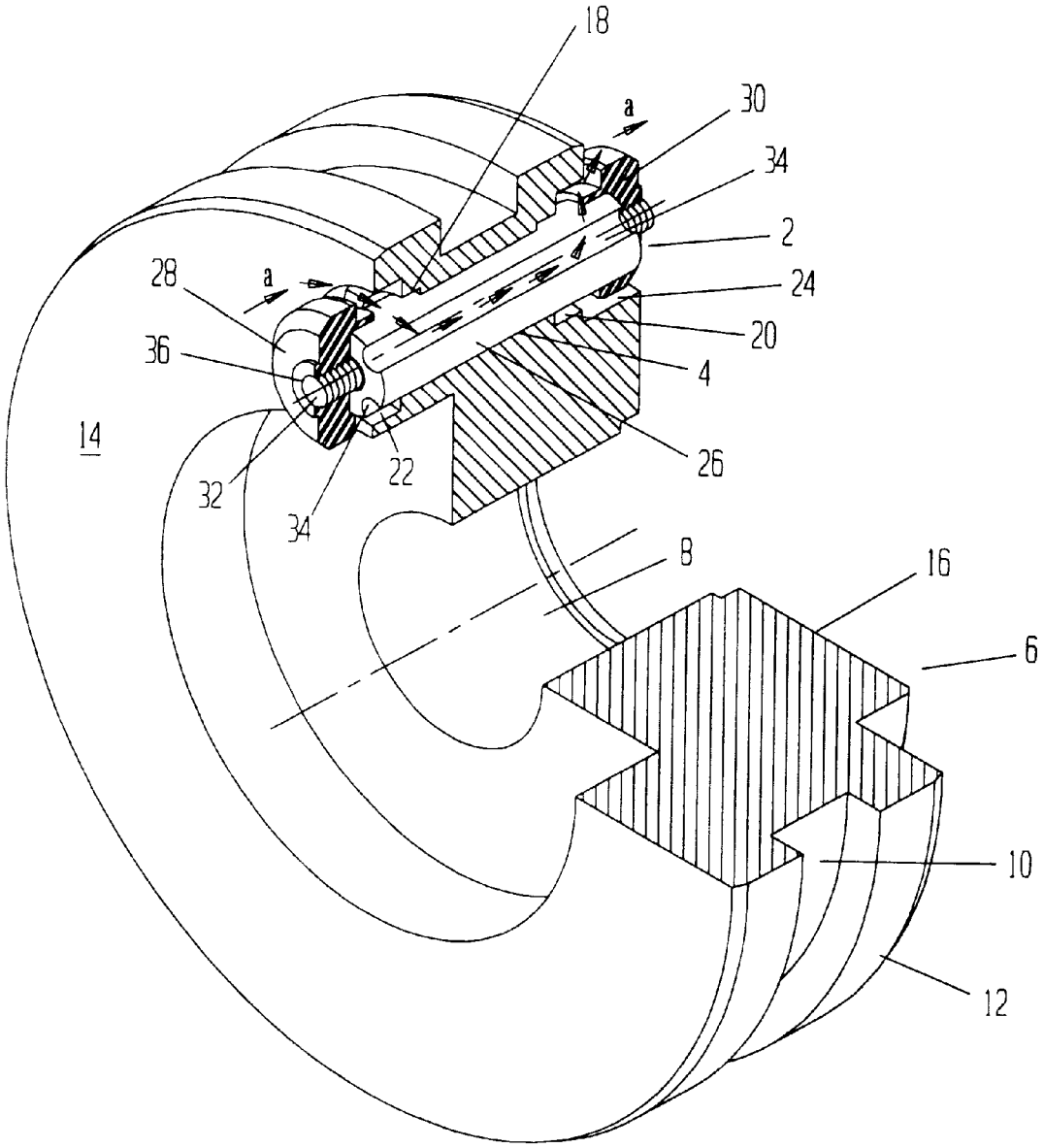
FIG. 1 is a cross sectional view in perspective of a piston with the preferred embodiment bypass valve in place therein.

Referring to FIG. 1 of the drawings, it can be seen that the preferred embodiment bypass valve 2 is mounted in a bore 4 through piston 6. Bore 4 is axially parallel to the axis of piston rod opening 8 of piston 6 and is spaced apart therefrom. Piston 6 is provided with sealing ring channel 10 about the circumferential edge 12 thereof. Bore 4 extends from first face 14 of piston 6 to second face 16 thereof and is provided with coaxial inner counterbores 18, 20 and outer counterbores 22, 24 on first face 14 and second face 16 respectively. Outer counterbores 22, 24 are shallower and of larger diameter than inner counterbore 18, 20.

Bypass valve 2 comprises an elongate cylinder midsection 26 provided with end caps 28, 30 at its opposing ends. Each of end caps 28 and 30 is retained to midsection 26 by means of its threading onto central shaft 32 which extends axially through midsection 26. End caps 28 and 30 serve as stop members to limit the longitudinal movement of cylindrical midsection 26.

One or more longitudinal grooves 34 (preferably 4) are machined into the exterior of midsection 26 of bypass valve 2 and extend the length of midsection 26. When bypass valve 2 is in its open position as illustrated in FIG. 1, working fluid applying pressure to first face 14 may pass along the exterior of midsection 26 along one of longitudinal grooves 34 as indicated by arrows a.

Figure 2:
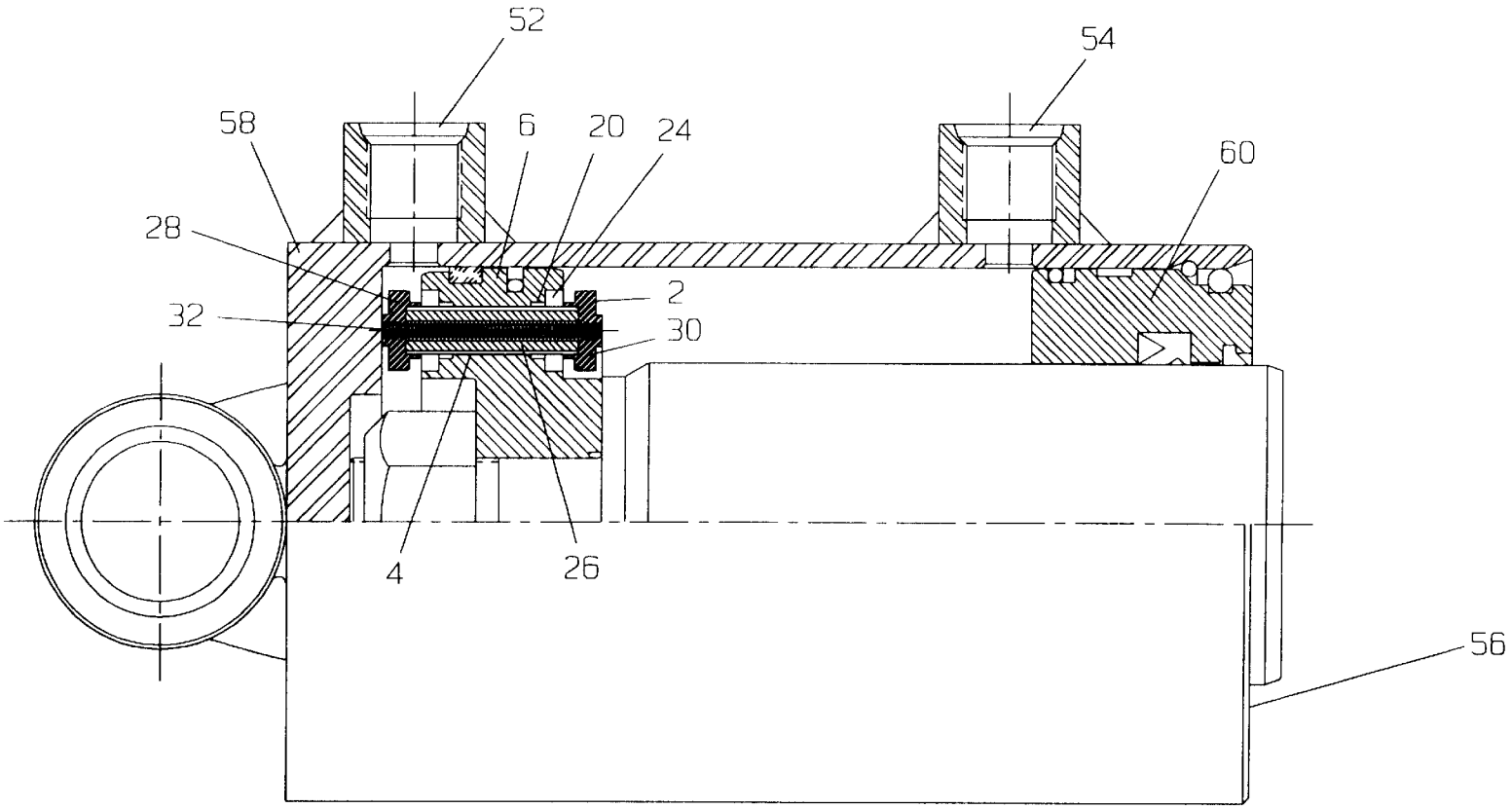
FIG. 2 is a partly cut away elevation of a cylinder equipped with a piston provided with the preferred embodiment bypass valve with the cylinder at rest in its fully retracted position and the bypass valve open.
Figure 3:
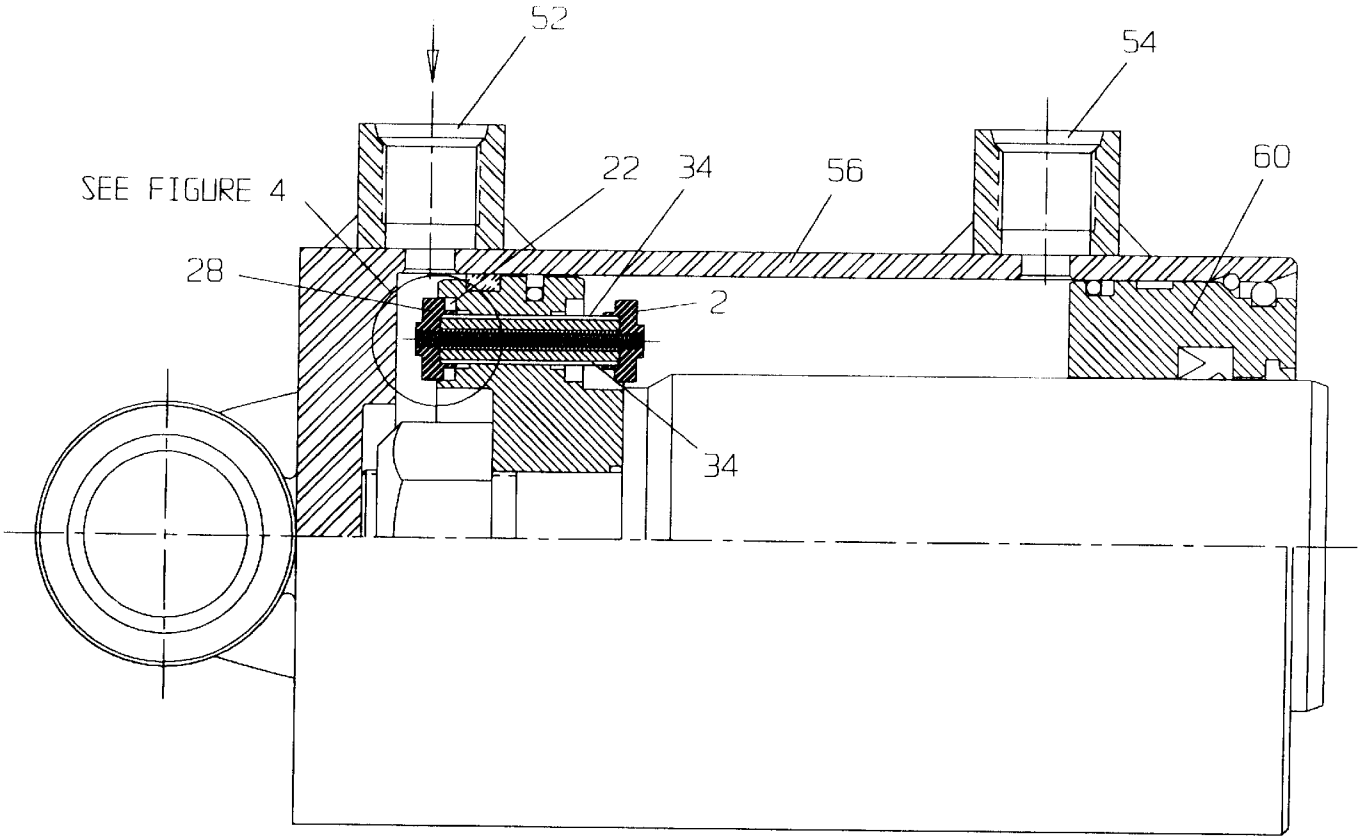
FIG. 3 is a partly cut away elevation of the cylinder of FIG. 2 with the part of the piston equipped with the preferred embodiment bypass valve shown in section, the bypass valve shown partially moved to a closed position as working fluid enters the extend port of the cylinder.
Figure 4:
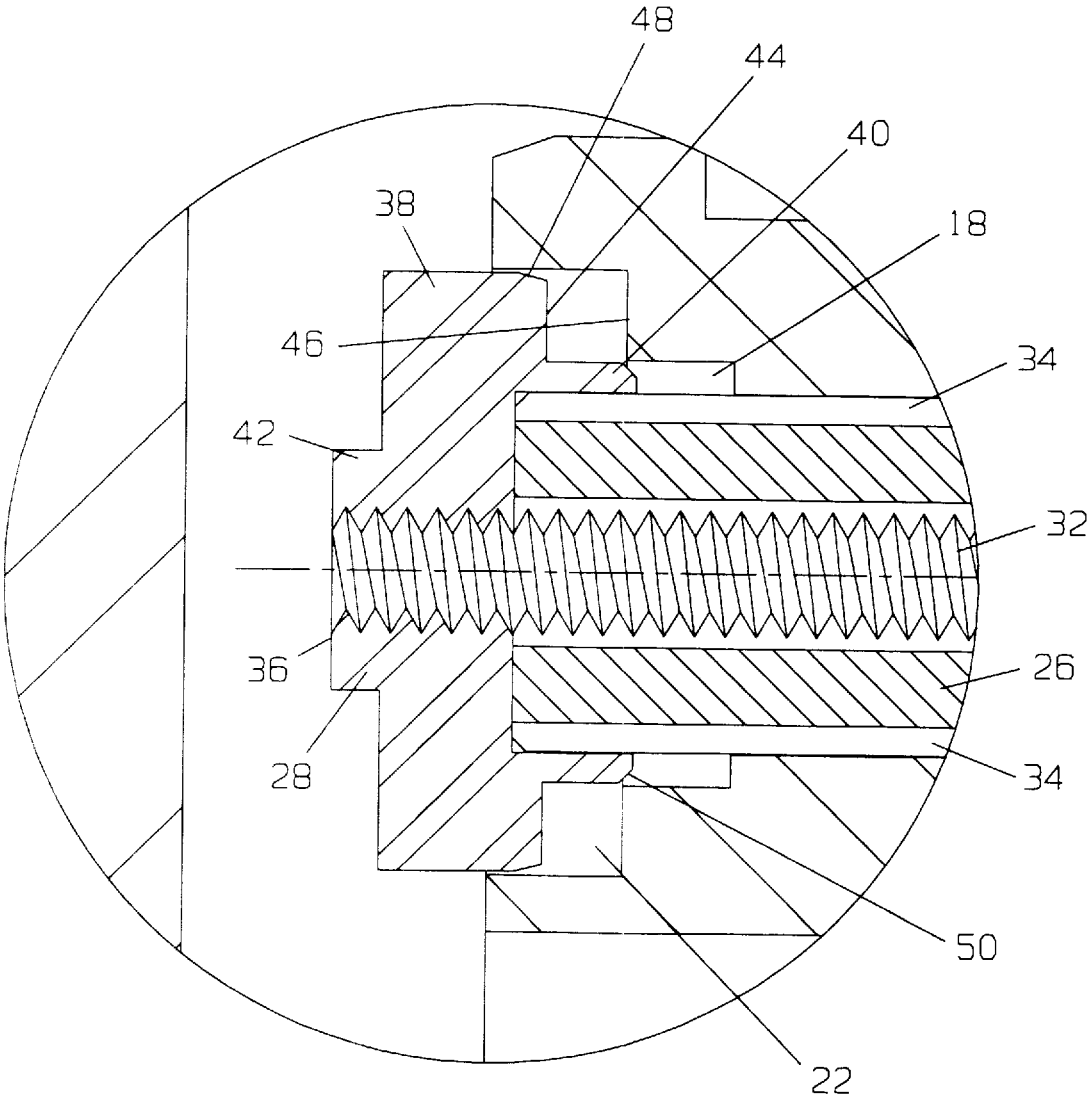
FIG. 4 is an expanded view in section of one end of the preferred embodiment bypass valve illustrated in FIG. 3.

Referring further to FIG. 1 and also to FIGS. 2–4, it can be seen that central shaft 32 is preferably threaded and is matingly inserted in a threaded bore which extends the full length of midsection 26. Central shaft 32 protrudes from each end of midsection 26 to provide mounting posts to which end caps 28, 30 may be mounted. Each end cap 28, 30 is provided with a threaded central opening 36 to receive an end of central shaft 32.

End caps 28, 30 each comprise a cylindrical body 38 with a hollow cylindrical cup element 40 depending therefrom on a first end thereof. Cup element 40 is sized to receive an end of midsection 26 and to extend therealong a short length. A smaller diameter raised portion 42 of each end cap 28, 30 extends from cylindrical body 38 opposingly to cup element 40.

In FIG. 4, it can be seen that cup element 40 may serve as a cushion spear as cup element 40 enters inner counterbore 18 such that trapped working fluid, typically hydraulic oil, cushions the entry of cup element 40 into inner counterbore 18. Similarly, cylindrical body 38 enters outer counterbore 22 and traps working fluid in outer counterbore 22 which cushions the approach of sealing face 44 of cylinder body 38 to the mating surface 46 of outer counterbore 22.

A chamfer 48 is provided on the edge of cylindrical body 38 to enable trapped working fluid to urge end cap 28 into a centered position as it enters outer counterbore 22 and inner counterbore 18. Similarly a chamfer 50 is provided on the edge of cup element 40 to similarly assist with centering of end cap 28.

It is to be understood that no radial or other ports in the piston 6 are required for the preferred embodiment bypass valve 2 to operate. The bypassed working fluid (typically hydraulic oil) travels along longitudinal grooves 34 when both end caps 28, 30 are displaced from their closed position seated in outer counterbores 22, 24 and inner counterbores 18, 20 respectively. One longitudinal groove 34 is sufficient to allow operation of bypass valve 2, but a multiple of longitudinal grooves equally spaced on midsection 26 is preferable to equalize forces about midsection 26.

Referring to FIGS. 2–7, the various states of operation of bypass valve 2 can be visualized. In FIG. 2, bypass valve 2 is shown at rest with the cylinder 56 in fully retracted position and piston 6 is adjacent cylinder end cap 58. Bypass valve 2 is in a fully open position with its midsection 26 evenly spaced along bore 4. Neither end cap 28, 30 is inserted in outer counterbores 18, 20.

In FIG. 3, bypass valve 2 has moved toward its first closed position as working fluid is introduced through extend port 52. Because working fluid becomes trapped in outer counterbore 22, end cap 28 is prevented from immediately becoming fully abutted to annular mating surface 46 within outer counterbore 22. Any substantial amount of working fluid is prevented from moving along longitudinal grooves 34 because end cap 28 has begun to enter outer counterbore 22. The transfer of bypass valve 2 from the open condition of FIG. 2 to the partially closed position of FIG. 3 occurs at high speed and the bypass valve 2 is advantageously cushioned by the presence of working fluid trapped in the chamber in outer counterbore 22 between end cap 28 and mating surface 46.

Figure 5:
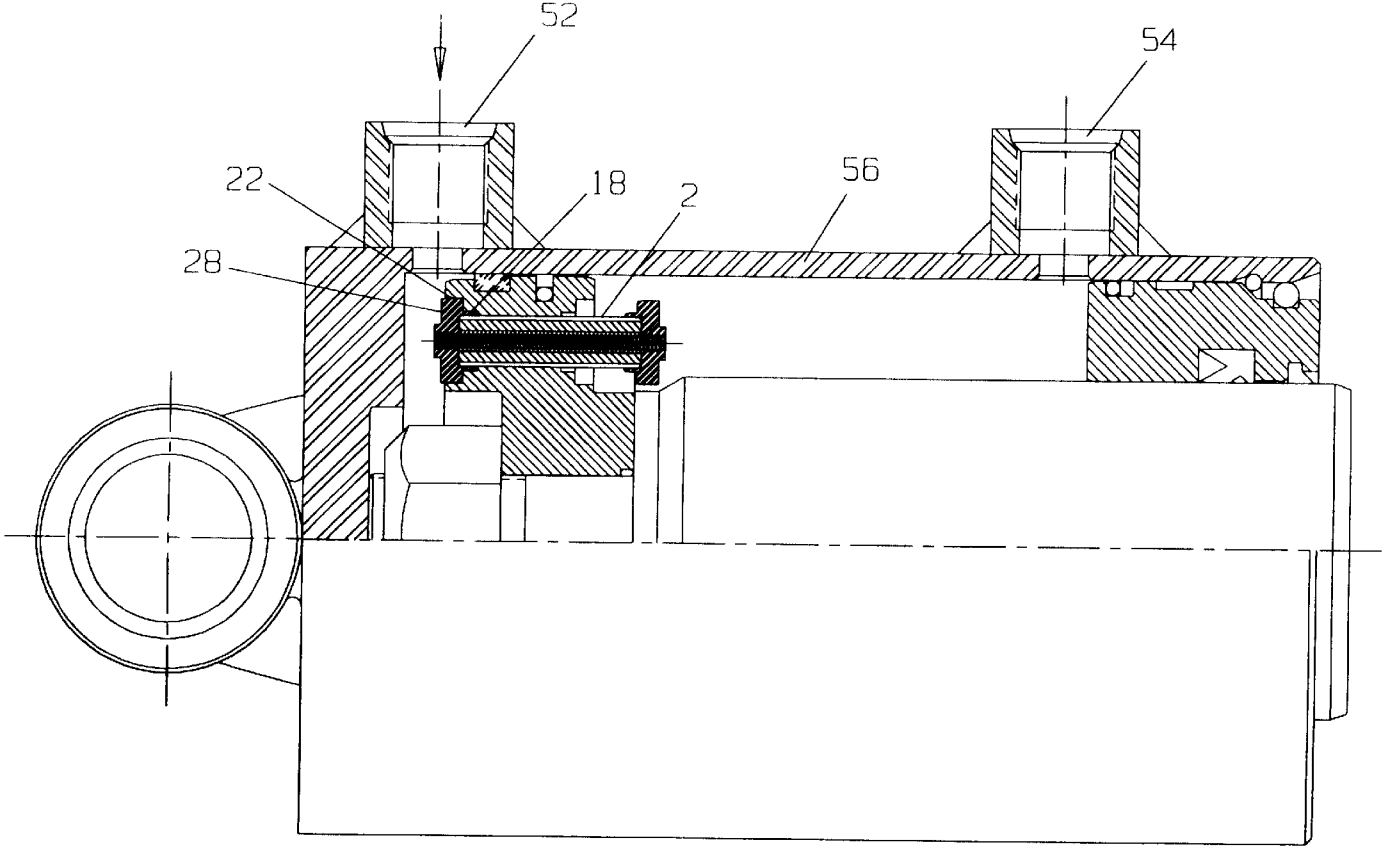
FIG. 5 is a partly cut away elevation of the cylinder of FIG. 2 with the preferred embodiment bypass valve shown in cross section in its fully closed position as the cylinder begins to extend.

In FIG. 5, the bypass valve 2 is depicted in a fully closed position with end cap 28 fully inserted within outer counterbore 22 and inner counterbore 18. Working fluid earlier trapped in outer counterbore 22 has quickly drained away and sealing face 44 of end cap 28 (see FIG. 4) is seated in a metal-to-metal seal against mating surface 46 of outer counterbore 22 and working fluid is effectively prevented from entering longitudinal grooves 34. Piston 6 begins to travel to the right within cylinder 56.

Figure 6:
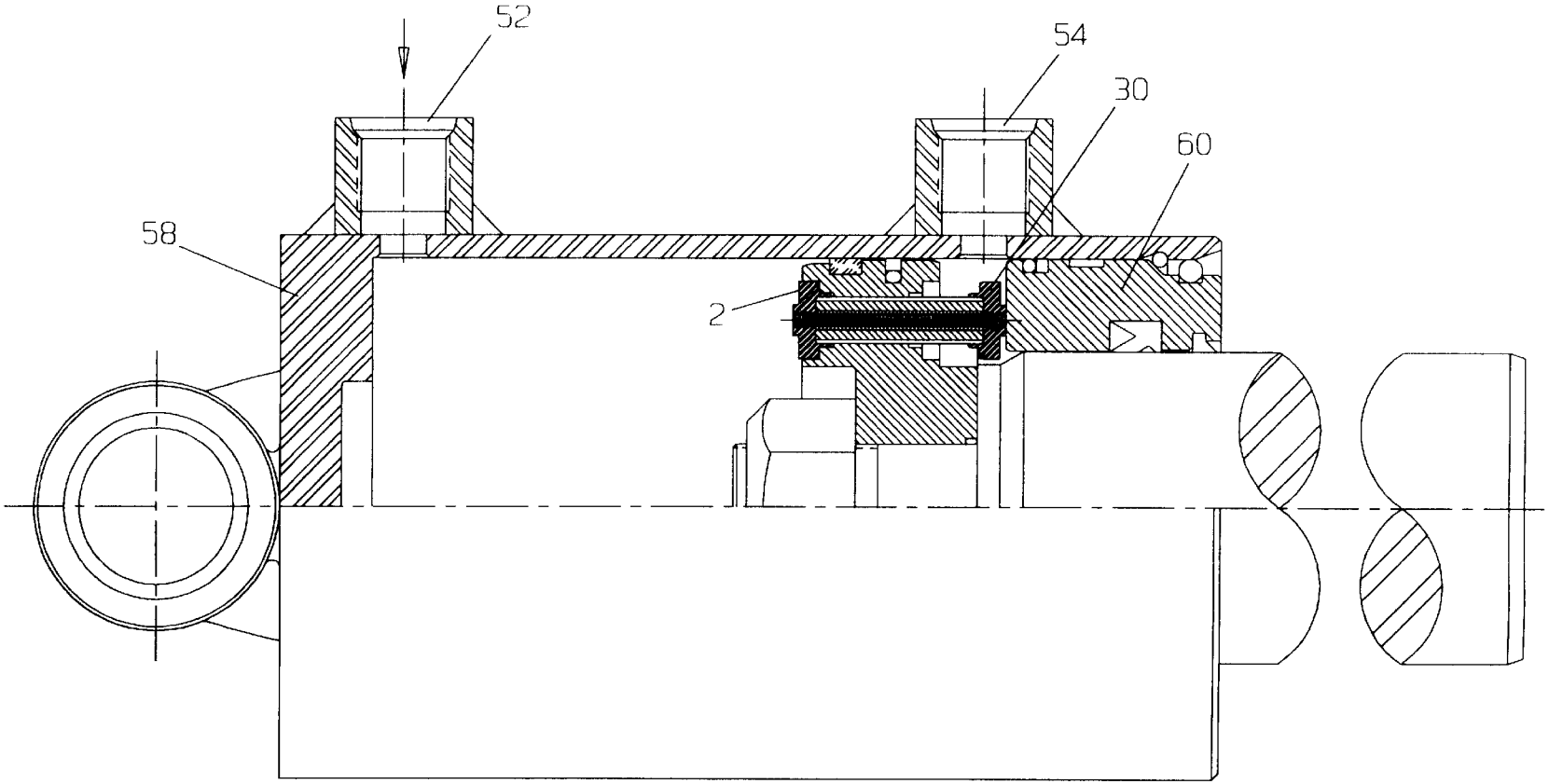
FIG. 6 is a partly cut away elevation of the cylinder of FIG. 2 shown with one end of the bypass valve touching the rod guide of the cylinder and beginning to open as the cylinder approaches its fully extended position.

FIG. 6 illustrates the cylinder 56 as piston 6 approaches rod guide 60 and end cap 30 of bypass valve 2 abuts rod guide 60. Piston 6 may continue to travel toward rod guide 60 as working fluid continues to be pumped through external port 52, but bypass valve 2 cannot move further to the right.

Figure 7:
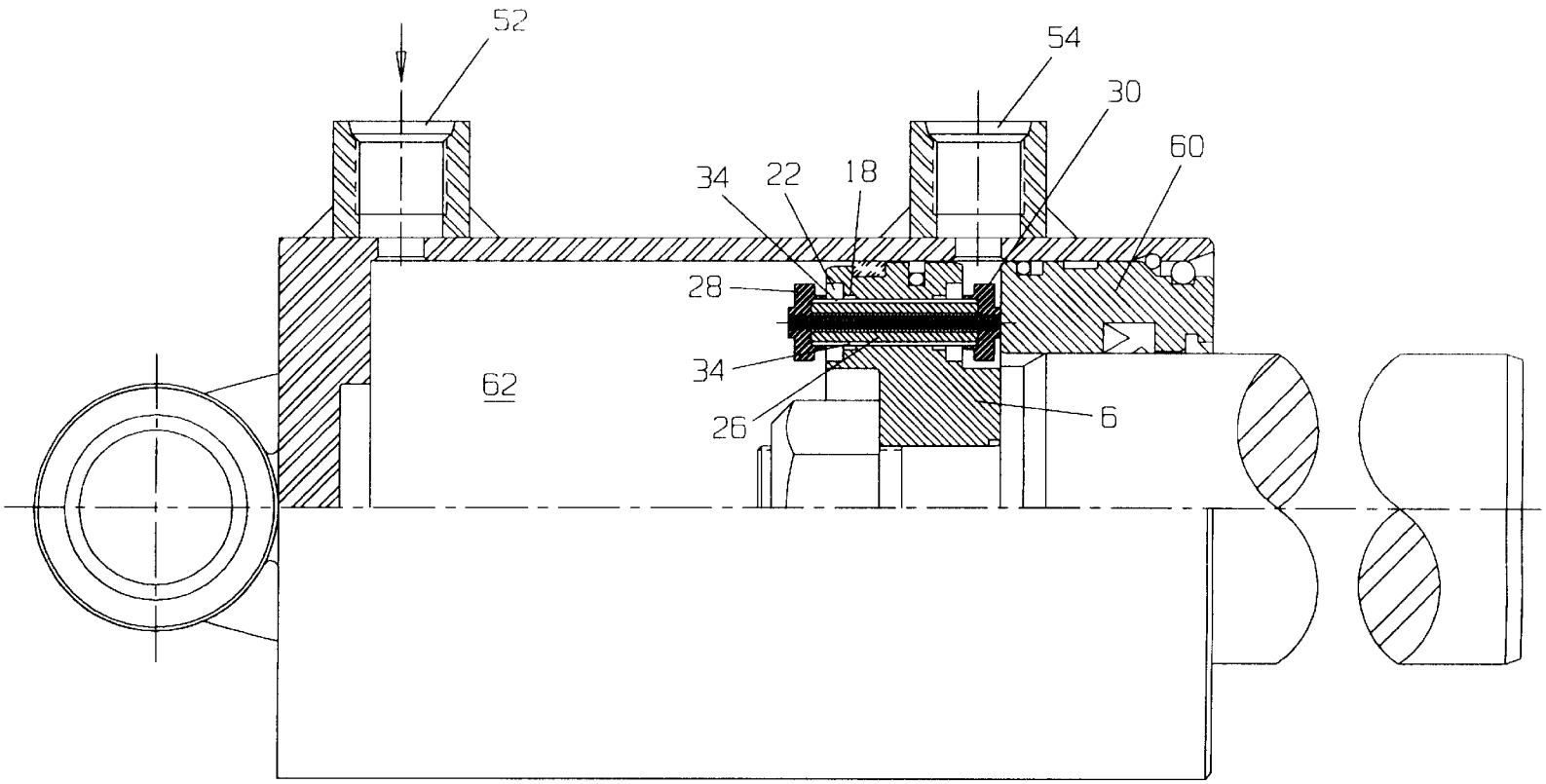
FIG. 7 is a partly cut away elevation of the cylinder of FIG. 2 shown with the bypass valve fully open due to its having been displaced toward the left from its engagement with the rod guide of the cylinder.

FIG. 7 depicts the bypass valve 2 in an open position due to the urging of rod guide 60 on end cap 30 as piston 6 approaches rod guide 60. Working fluid in chamber 62 of cylinder 56 can travel along longitudinal grooves 34 of midsection 26 of bypass valve 2 because end cap 28 has been displaced from its position within outer counterbore 22 and inner counterbore 18. Piston 6 has reached the limit of its travel. The fully-opened bypass valve 2 allows oil to pass through the piston and prevent pressure buildup and undue mechanical stress on the rod guide 60. When flow to the cylinder 56 is reversed and working fluid enters retract port 54, the bypass valve 2 functions in the opposite direction.

Having described the invention, I claim:

1. A piston reciprocable within a hydraulic cylinder having an end cap and a rod guide on the ends thereof, comprising the piston having a bore therethrough, said bore being spaced apart from and axially parallel to the axis of said piston, an elongate valve spool slidably receivable in said bore, said spool having two opposing ends, said spool being longer than said bore, said spool having at least one longitudinal groove therealong, said groove longer than said bore, said spool having stop members fixed to each end thereof, each of said stop members having a cup extending from an end thereof, the cup of each of said stop members receiving one of said ends of said spool, counterbores are provided upon each end of said bore of said piston, said counterbores are coaxial with said bore, said stop members are cylindrical and coaxial with said valve spool, said stop members are slidably receivable in said counterbores, said stop members interact with said counterbores to provide a seal therebetween, each of said counterbores comprises a deeper counterbore and a shallower counterbore, said deeper counterbore and said shallower counterbore coaxial with said bore, said shallower counterbore of larger diameter than said deeper counterbore, said cup of one of said stop members is slidably receivable in a first of said deeper counterbores when said one of said stop members is received in said shallower counterbore associated with said first of said deeper counterbores, said cup of the other of said stop members is slidably receivable in the other of said deeper counterbores when said other of said stop members is received in said shallower counterbore associated with said other of said deeper counterbores.

2. The piston of claim 1 wherein each of said stop members has an annular inner face thereon, each of said shallower counterbores having a seat portion therein, said inner faces of said stop members abutting the seat portions of said shallower counterbores to effect a seal therewith.

3. The piston of claim 2 wherein each of said stop members has an end wall thereon, the end wall of a first of said stop members engageable with the end cap of said cylinder when said piston approaches said end cap, said first stop member when in engagement with said end cap being urged toward said piston, the end wall of the other of said stop members engageable with the rod guide of said cylinder when said piston approaches said rod guide, said other stop member when in engagement with said rod guide being urged toward said piston.

4. A relief valve for a piston reciprocable within a cylinder having a rod guide and an end cap, comprising a cylindrical body with opposing ends, stop members fixed to each of the ends of the cylindrical body, said cylindrical body having a threaded axial passageway therethrough, a threaded shaft received in said axial passageway, said piston having an opening therethrough which is axially parallel to the axis of the piston, said cylindrical body slidable within said opening of said piston, said stop members being coaxial with said cylindrical body, said opening of said piston having opposing ends thereon, said piston having first and second coaxial counterbores at each end of said opening, said first and second counterbores coaxial with said opening, said stop members being cylindrical, each of said stop members slidably receivable within one of said counterbores when said cylindrical body is received in said opening of said piston.

5. The valve of claim 4 wherein said cylindrical body has at least one longitudinal channel therealong, said longitudinal channel longer than the length of said bore between said counterbores.

6. The valve of claim 4 wherein each of said first counterbores is an outer counterbore and each of said second counterbores is an inner counterbore, each of said outer counterbores having an inner annular surface thereon, each of said stop members having an annular face abuttable with the inner annular surface of the outer counterbore in which it is received, the annular face of each of said stop members cooperating with the annular surface of said outer counterbore in which the stop member is received to form a seal when abutted.

7. The valve of claim 4 wherein one of said stop members is interactive with said end cap of said cylinder to urge said cylindrical body in opposition to the movement of the piston, the other of said stop members interactive with said rod guide of said cylinder to urge said cylindrical body in opposition to the movement of the piston.

8. The valve of claim 4 wherein said stop members are fixed to said cylindrical body by said threaded shaft.

9. The valve of claim 4 wherein said cylindrical body has a plurality of longitudinal channels therealong, each of said longitudinal channels longer than the length of said bore between said counterbores.

10. The valve of claim 9 wherein each of said plurality of longitudinal channels is equidistant from the others of said plurality of longitudinal channels.

11. A piston reciprocable within a hydraulic cylinder having an end cap and a rod guide on the opposing ends thereof, comprising the piston having a bore therethrough, said bore being spaced apart from and axially parallel to the axis of said piston, an elongate valve spool slidably receivable in said bore, said spool having at least one longitudinal groove therealong, said spool having two opposing ends, said spool having stop members fixed to each end thereof, said spool being longer than said bore, said at least one longitudinal groove of length greater than the length of said bore, counterbores are provided upon each end of said bore of said piston, each of said counterbores comprises a deeper counterbore and a shallower counterbore, said deeper counterbore and said shallower counterbore each coaxial with said bore, said shallower counterbore of larger diameter than said deeper counterbore, each of said stop members comprises a cylindrical member and a hollow cylindrical element extending therefrom, each of the cylindrical members slidably receivable in one of said shallower counterbores, each of the hollow cylindrical elements slidably receivable in one of said deeper counterbores.

12. The piston of claim 11 wherein each of said cylindrical members of said stop members has a circumferential edge adjacent said spool, said circumferential edge of each of said cylindrical members is chamfered.

13. The piston of claim 11 wherein each of said hollow cylindrical elements of said stop members has a circumferential shoulder adjacent said spool, said circumferential shoulder of each of said hollow cylindrical elements is chamfered.

14. A relief valve for a piston reciprocable within a cylinder having a rod guide and an end cap, comprising a cylindrical body with opposing ends, stop members fixed to each of the ends of the cylindrical body, said cylindrical body having an axial bore therethrough, a threaded shaft received in said axial bore, said shaft having threads along the full length thereof, said piston having an opening therethrough which is axially parallel to the axis of the piston, said cylindrical body slidable within said opening of said piston, said stop members being coaxial with said cylindrical body, said opening of said piston having opposing ends thereon, counterbores are provided upon each end of said opening of said piston, said counterbores coaxial with said opening, said stop members being cylindrical, each of said stop members slidably receivable within one of said counterbores when said cylindrical body is received in said opening of said piston, said stop members are fixed to said cylindrical body by said threaded shaft.

15. The valve of claim 14 wherein at least one of said counterbores comprises a deeper counterbore and a shallower counterbore, said deeper counterbore and said shallower counterbore each coaxial with said opening, said shallower counterbore of larger diameter than said deeper counterbore.

at least one of said stop members comprises a cylindrical member and a hollow cylindrical element extending therefrom, said cylindrical member slidably receivable in said shallower counterbore, said hollow cylindrical element slidably receivable in said deeper counterbore.

16. The valve of claim 14 wherein each of said counterbores comprises a deeper counterbore and a shallower counterbore, each of said stop members comprises a cylindrical member and a hollow cylindrical element extending therefrom, each of the cylindrical members slidably receivable in one of said shallower counterbores, each of said hollow cylindrical elements slidably receivable in one of said deeper counterbores.

17. The valve of claim 16 wherein said cylindrical body has at least one longitudinal channel therealong, said longitudinal channel longer than the length of said bore between said counterbores.

18. A relief valve for a piston reciprocable within a cylinder having a rod guide and an end cap, comprising a cylindrical body with opposing ends, stop members fixed to each of the ends of the cylindrical body, said piston having an opening therethrough which is axially parallel to the axis of the piston, said cylindrical body slidable within said opening of said piston, said stop members being coaxial with said cylindrical body, said opening of said piston having opposing ends thereon, a counterbore is provided upon at least one end of said opening of said piston, said counterbore coaxial with said opening, said stop members being cylindrical, said counterbore comprises a deeper counterbore and a shallower counterbore, said deeper counterbore and said shallower counterbore each coaxial with said opening, said shallower counterbore of larger diameter than said deeper counterbore, at least one of said stop members comprises a cylindrical member and a hollow cylindrical element extending therefrom, said cylindrical member slidably receivable in said shallower counterbore, said hollow cylindrical element slidably receivable in said deeper counterbore.

19. The piston of claim 18 wherein said spool having at least one longitudinal groove therealong, said groove longer than said bore.

20. A piston reciprocable within a hydraulic cylinder having an end cap and a rod guide on the ends thereof, comprising the piston having a bore therethrough, said bore being spaced apart from and axially parallel to the axis of said piston, an elongate valve spool slidably receivable in said bore, said spool having two opposing ends, said spool being longer than said bore, said spool having stop members fixed to each end thereof, at least one of said stop members having a cup extending from an end thereof, the cup of said at least one of said stop members receiving one of said ends of said spool, counterbores are provided upon each end of said bore of said piston, said counterbores are coaxial with said bore, said stop members are cylindrical and coaxial with said valve spool, said stop members are slidably receivable in said counterbores, said stop members interact with said counterbores to provide a seal therebetween, at least one of said counterbores comprises a deeper counterbore and a shallower counterbore, said deeper counterbore and said shallower counterbore coaxial with said bore, said shallower counterbore of larger diameter than said deeper counterbore, said cup of said at least one of said stop members is slidably receivable in said deeper counterbore when said at least one of said stop members is recieved in said shallower counterbore.

* * * * *